US006539551B1

(12) United States Patent
Jones, Jr.

(10) Patent No.: US 6,539,551 B1
(45) Date of Patent: Apr. 1, 2003

(54) GOLF TRAINING AID

(76) Inventor: Olin Edwin Jones, Jr., 1459 Comanche Trace, St. Charles, MO (US) 63304

( * ) Notice: Subject to any disclaimer, the term of this patent is extended or adjusted under 35 U.S.C. 154(b) by 24 days.

(21) Appl. No.: 09/978,334

(22) Filed: Oct. 16, 2001

(51) Int. Cl.[7] ..... A41D 19/00
(52) U.S. Cl. ..... 2/161.2; 2/159
(58) Field of Search ..... 2/16, 158, 159, 2/160, 161.1, 161.2, 161.6, 161.4; 473/205, 213, 458

(56) References Cited

U.S. PATENT DOCUMENTS

| | | | | |
|---|---|---|---|---|
| 2,154,197 A | | 4/1939 | Callaway | 2/159 |
| 2,831,196 A | | 4/1958 | Scheiber | 2/161.2 |
| 4,502,688 A | | 3/1985 | Papp | 273/189 A |
| 5,180,169 A | | 1/1993 | Choy | 273/189 A |
| 5,453,064 A | * | 9/1995 | Williams, Jr. | 2/161.1 |
| 5,456,650 A | | 10/1995 | Williams, Jr. et al. | 482/47 |
| 5,492,331 A | | 2/1996 | Kawakami | 273/189 A |
| 5,511,247 A | | 4/1996 | Block | 2/161.1 |
| 5,638,548 A | | 6/1997 | Kawakami | 2/161.1 |
| 5,740,555 A | | 4/1998 | Renegar | 2/161.2 |
| 5,876,292 A | * | 3/1999 | Hamilton | 473/213 |

* cited by examiner

*Primary Examiner*—Gary L. Welch
(74) *Attorney, Agent, or Firm*—Grace J. Fishel

(57) ABSTRACT

A golf training aid uses a golf glove having a structure to remind the wearer to hold the target wrist unflexed through the contact part of the swing. The structure provides a tactile reminder if the wrist is flexed. The structure may be a strip installed in a pocket or other holder in or on the glove. The pocket and strip may be adjusted to place an end of the strip near a pivot axis of the user's target wrist.

15 Claims, 4 Drawing Sheets

GOLF TRAINING AID

BACKGROUND OF THE INVENTION

1. Field of the Invention

The present invention relates to the field of sports equipment and especially to equipment for the sport of golf. In particular, the invention relates to a golf training aid.

2. Brief Description of the Prior Art

A good golf swing underlies all shots, from the teeing area through shots near the green. The fundamental aspects of the swing stay the same, but the length and pace of the swing vary depending on the shot and club. Ideally the head is squarely aligned with the ball at the point of impact. How the player's wrist is flexed and cocked during the swing affects whether ideal contact is made with the ball. A significant part of learning golf is learning the most efficient and consistent wrist motion for the forward or target hand. For a right handed player, the forward or target hand is the left hand. For a left handed player, the forward or target hand is the right hand.

At the moment of impact of the club head with the ball, the shaft of the club, the wrist of the target hand, and the forearm of the target hand should all be aligned along a common axis, as explained herein. The wrist of the target hand should not be flexed forward, i.e., in the direction of the stroke, and should not be flexed backward, i.e., lagging behind the stroke, at the moment of impact.

The art has devised a number of devices to achieve the proper wrist position. These devices typically restrain the wrist to hold the wrist, forearm and club shaft generally in alignment along a common axis. The following United States patents are incorporated by reference herein: U.S. Pat. No. 2,154,197, U.S. Pat. No. 2,831,196, U.S. Pat. No. 4,502,688, U.S. Pat. No. 5,180,169, U.S. Pat. No. 5,456,650, U.S. Pat. No. 5,492,331, U.S. Pat. No. 5,511,247, U.S. Pat. No. 5,638,548 and U.S. Pat. No. 5,740,555.

BRIEF SUMMARY OF THE INVENTION

A golf training aid in accordance with the present invention is designed to help a golfer achieve a dependable, repeatable and effective swing. The device of the invention permits the golfer to utilize the full unrestrained flexibility of the wrist of the target hand so that the proper motion can be achieved throughout the backswing, the contact stroke and the follow through. If the wrist is restrained, a full follow through cannot be achieved with the desired fluid motion. As a consequence, the golfer must stop the stroke short of a full follow through or use an awkward finish to the swing, both of which are undesirable. A short swing requires the golfer to decelerate the stroke too rapidly, which may cause an injury or result in a muffed shot. The alternative to rapid deceleration is to play a soft shot, which is also undesirable since the distance of the shot is reduced.

Preferably, the device of the invention does not appreciably restrain the motion of the wrist of the target hand. The device of the invention utilizes a golf glove which has been modified in a novel way to provide a tactile reminder which conditions the golfer to align the target forearm, the wrist of the target hand and the club shaft at the moment of impact between the club head and the ball. The tactile reminder is comfortable to wear and does not interfere with finesse or cut shots which require wrist action which deviates from that used in a full swing.

In one embodiment of the invention, as described herein, the tactile reminder is a thin strip inserted in the golf glove.

The strip is not tightly fixed to the golf glove and may be moved axially along the hand of the golfer to provide an increase or a decrease in the tactile sensation provided by the tactile reminder.

It is thus an object of the present invention to provide a golf training aid for teaching or improving a person's golf swing. It is another object to teach a golfer the proper wrist action in performing a full or distance swing. It is a further object to provide a golf training aid which does not substantially restrict the wrist action during the full stroke of the club and which permits a modified wrist action for finesse or cut shots. Other objects and features of the invention will be in part apparent and in part pointed out hereinafter.

The invention summarized above comprises the constructions hereinafter described, the scope of the invention being indicated by the subjoined claims.

BRIEF DESCRIPTION OF THE SEVERAL VIEWS OF THE DRAWING

FIG. 8 is a detail view taken from FIG. 7 showing the position of the golfer's hands at the top of the follow through.

DESCRIPTION OF THE PREFERRED EMBODIMENTS

A full or distance swing in golf is intended to generate maximum power and achieve maximum distance for the chosen club. The swing starts, after the ball has been addressed, with a backswing. Ideally, the club is drawn back with a straight target arm until the shaft of the club is above the head of the golfer and nearly parallel to the ground without flexing the target hand with respect to the target forearm. In this position the wrist of the target hand is cocked at an angle, that is, the wrist is turned away from the direction of the stroke.

During the stroke the wrist is uncocked until, at the moment of impact between the club head and the ball, the forearm of the target hand, the wrist of the target hand and the shaft of the club are aligned along a common axis, as further described herein. If the wrist of the target hand is flexed at the moment of impact, the club face will not properly contact the ball and the shot will usually be erratic.

Figure 1:
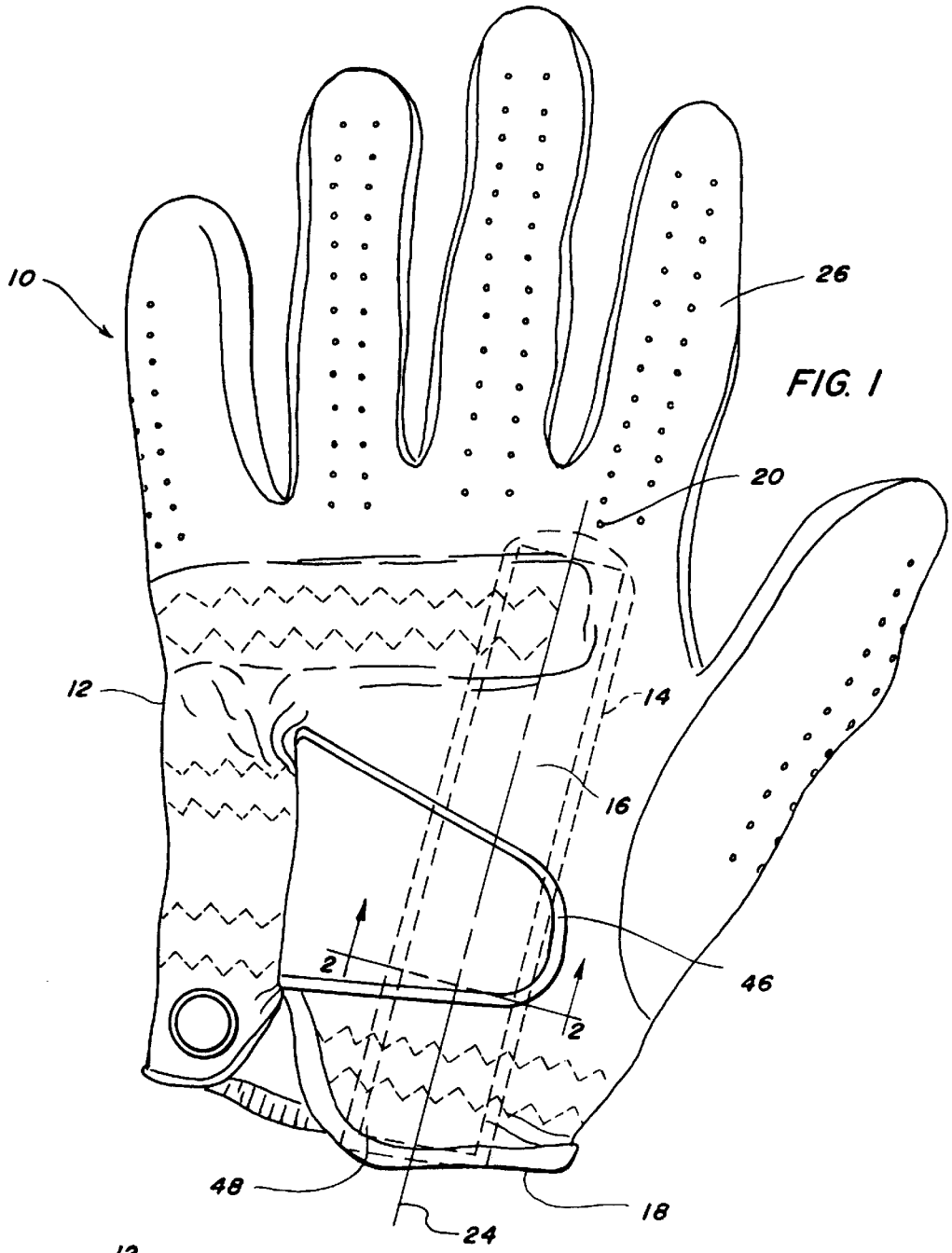
FIG. 1 is a top plan view of a golf training aid in accordance with the present invention.

Referring to FIG. 1, a golf training aid 10 of the invention is shown. Training aid 10 includes a glove 12 which is shown as a glove for the left hand or target hand of a right handed player. As shown in phantom in FIG. 1, glove 12 has a pocket 14 installed in the interior of the glove. A tactile reminder 16 is received in pocket 14, as shown.

Figure 2:
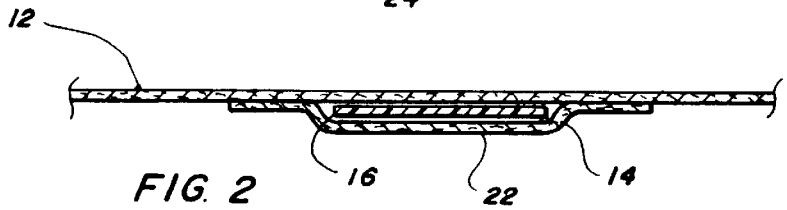
FIG. 2 is a cross-sectional view taken along the plane 2—2 in FIG. 1.

With continuing reference to FIG. 1 in combination with FIG. 2, tactile reminder 16 is a thin strip of a generally rectangular shape. Tactile reminder 16 may be formed of a stiff material such as a rigid or semi-rigid material, for example, plastic, wood, or even metal, though other materials could be used. It is preferred, however, that the material be plastic and semi-rigid so that tactile reminder 16 has enough flexibility that it does not poke the golfer's wrist enough to make it sore during a full round of golf. Pocket 14 and tactile reminder 16 are sized to permit sliding adjustment of tactile reminder 16 in pocket 14 and to retain a particular adjustment until deliberately moved. The resilience of glove 12, such as a leather glove, will normally hold the adjustment once set by the user.

Figure 6:
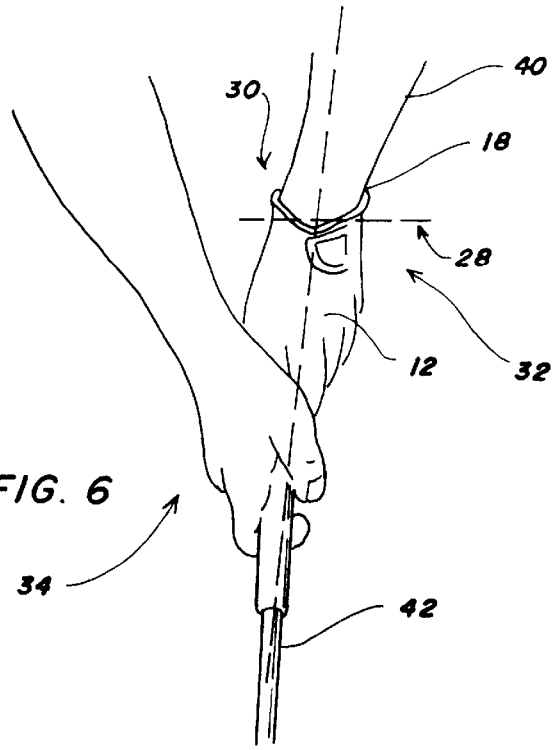
FIG. 6 is a detail view taken from FIG. 5 showing the position of the golfer's hands at the point of contact of the golf club and the ball.

The periphery of tactile reminder 16 may be curved or rounded at the corners, if desired, to permit ease of insertion of tactile reminder 16 into pocket 14, and to permit ease of adjustment. It will be appreciated that the exact shape and placement of tactile reminder 16 is not highly critical. An effective layout for tactile reminder 16 is shown in FIG. 1. With glove 12 on the hand of the user, not shown in FIG. 1, and with the fingers comfortably extended, pocket 14 for tactile reminder 16 may extend from near a wrist margin 18 of glove 12 to a position 20 near the first knuckle of the user. As noted above, tactile reminder 16 is adjustable along an interior 22 of pocket 14. As shown in FIG. 1, tactile reminder 16 has an axis 24 which is generally parallel and partially aligned with an index finger 26. As shown in FIG. 6, glove 12 is preferably sized to place wrist margin 18 of glove 12 adjacent to a pivot axis 28 of the user's wrist 30.

In use, a golfer 33 places golf training aid 10 on his or her target hand 32 with tactile reminder 16 installed in pocket 14. The position of golfer's target and a rear hand 32, 34 at the address of a ball 36 and also at the moment of impact between a club head 38 and a ball 36 is shown in FIG. 6. In this position ideally, a target wrist 30 of golfer 33 is not flexed and a target forearm 40, target hand 32 and a shaft 42 of a club 44 are generally aligned along a common axis.

A closure 46 of glove 12 is fastened to provide a slight sensation of touch between target hand 32 of golfer 33 and tactile reminder 16. A proximal end 48 of the tactile reminder 16 is placed adjacent to pivot axis 28 of target wrist 30, but does not extend so far as to interfere with the range of motion of wrist 30. The sensation of touch in the vicinity of wrist 30 increases or decreases, as wrist 30 is flexed, depending on the direction of flexure.

Figure 3:
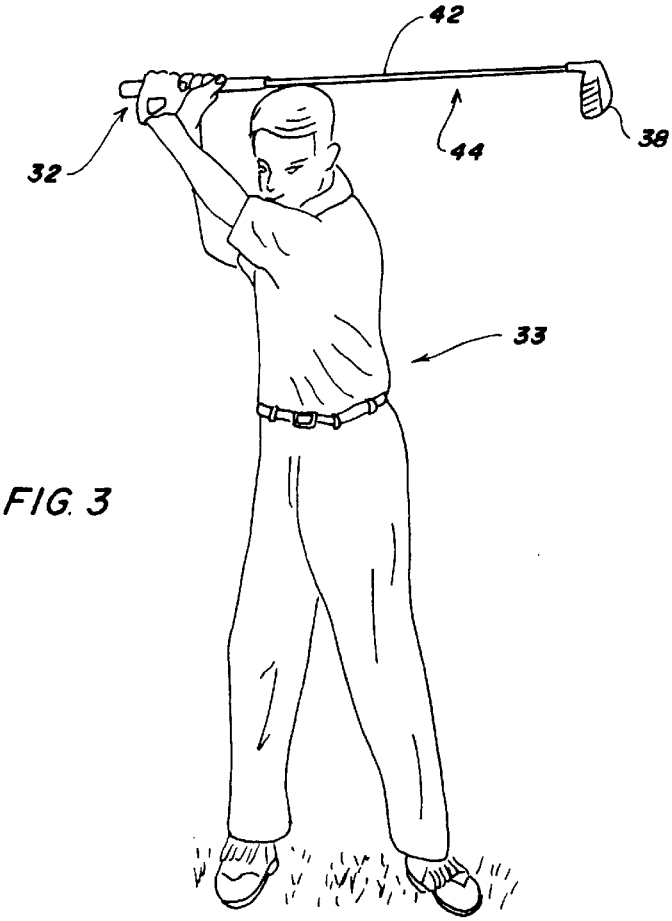
FIG. 3 is a perspective view of a golfer using the golf training aid of FIG. 1.
Figure 4:
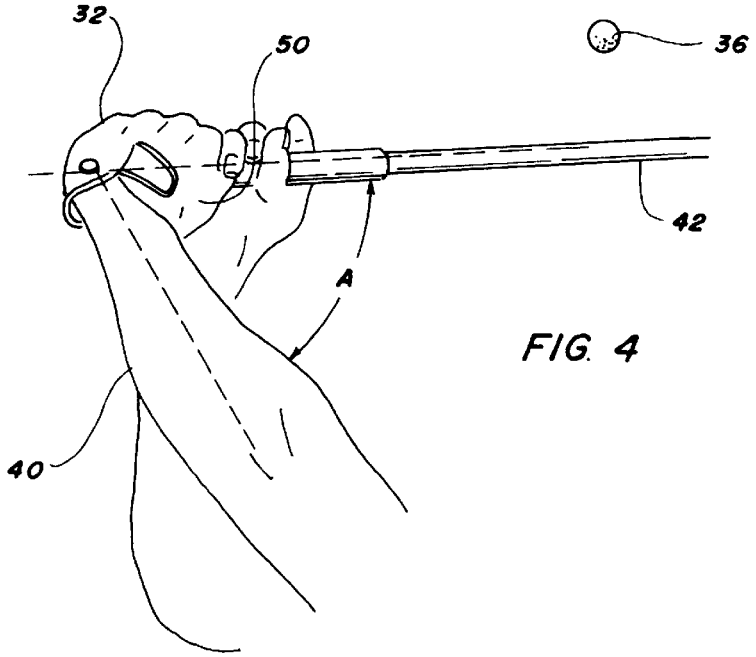
FIG. 4 is a detail view taken from FIG. 3 showing the position of the golfer's hands at the top of the backswing.

As shown in FIG. 3, golfer 33 moves club 44 through the backswing to the top position. At the top position target wrist 30 is cocked toward the interior or a thumb side 50 of target hand 32, shown in FIG. 4. In the position shown in FIG. 4, target forearm 40 and shaft 42 of club 44 form an angle A. Wrist 30 of target hand 32 is not flexed and target hand 32, target forearm 40 and shaft 42 of club 44 lie generally in the plane in which the stroke will develop.

Figure 5:
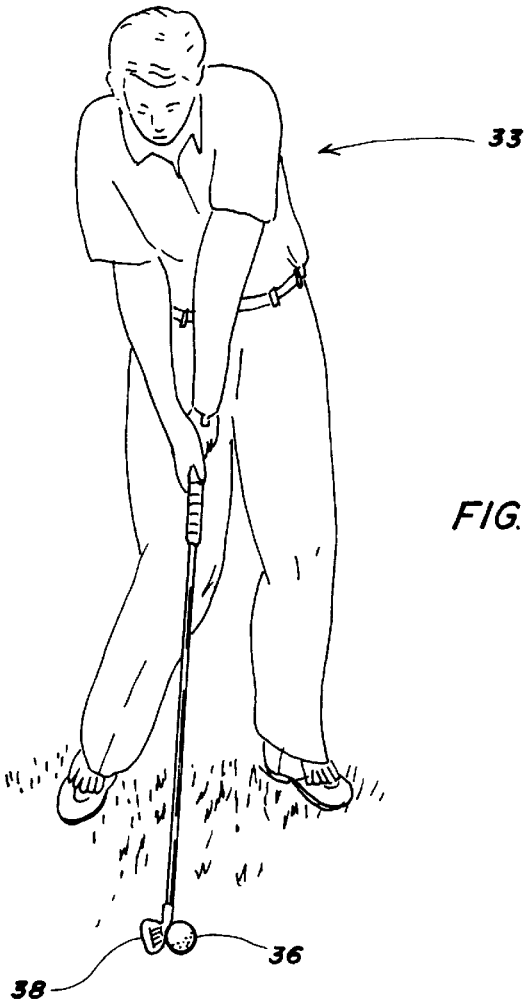
FIG. 5 is a further perspective view of a golfer using the golf training aid of FIG. 1.

From the top of the backswing shown in FIG. 3, golfer 33 develops the stroke by swinging club 44 downward in an arc to the contact point shown in FIG. 5. If golfer 33 flexes wrist 30 of target hand 32 during the downward swing the golfer will experience a slight sensation of increased or decreased pressure from tactile reminder 16, particularly in the vicinity of pivot axis 28 of wrist 30. The sensation provides a subtle, but effective reminder to hold wrist 30 unflexed. As known in the art, the elbow of target hand 32 holds the target arm straight during the backswing and the stroke through ball 36.

Figure 7:
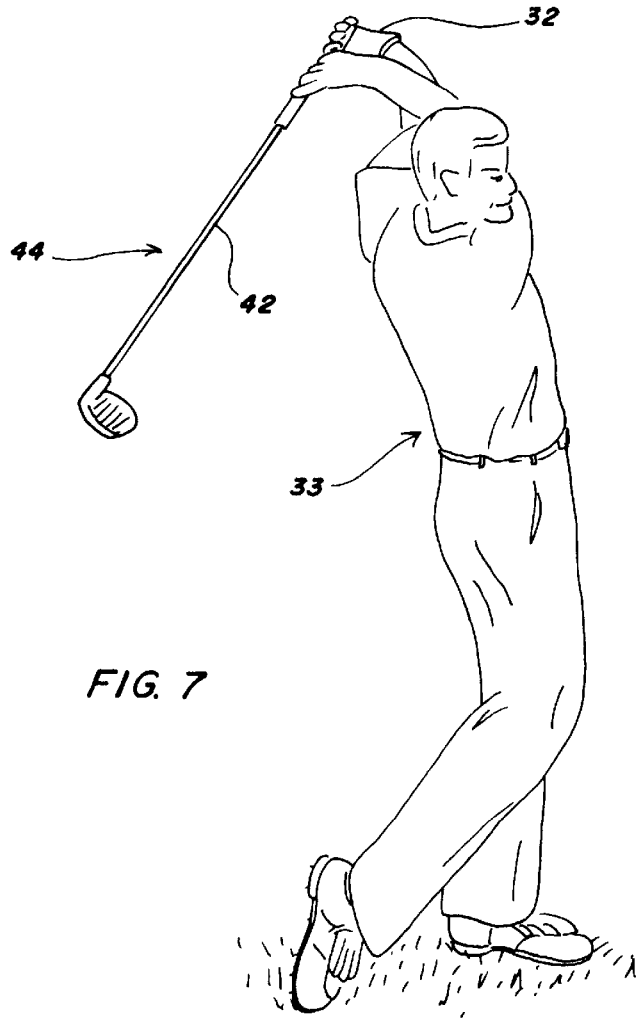
FIG. 7 is a further perspective view of a golfer using the golf training aid of FIG. 1.
Figure 8:
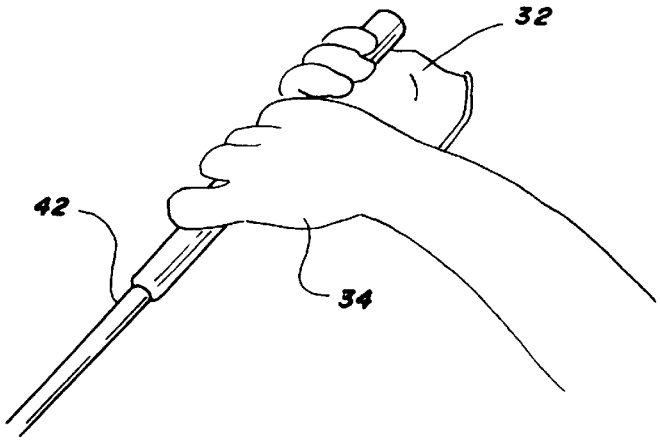

After club head 38 contacts ball 36 golfer 33 continues the swing of club 44 to the follow through position shown in FIG. 7. At the top of the follow through wrist 30 of target hand 32 may flex. The light contact and placement of the tactile reminder 16 permits this flexure to occur without discomfort.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense. For example, tactile reminder 16 is shown as being installed in pocket 14 in the interior of glove 12. It will be appreciated that tactile reminder 16 may be received on the exterior of glove 12 and that it may also be held in sliding clips or on pins. Tactile reminder is shown as a flat strip, but it could be circular in cross-section or have other cross-sections. It could also be a plurality of elongated members such as rods or tubes.

What is claimed:

1. A golf training aid comprising a golf glove, the golf glove terminating in a wrist margin that does not extend substantially beyond a pivot axis of a user's hand and having means for transmitting a tactile sensation to the hand of a user of the golf glove, the tactile sensation means being combined with the golf glove and extending from said pivot axis of a user's hand and angled towards a user's first knuckle but not extending beyond the user's first knuckle or said wrist margin of the glove and transmitting a tactile sensation to the user's hand, the golf glove and tactile sensation means including means for changing the tactile sensation if the wrist of the user is flexed, whereby the user of the glove is conditioned to keep the wrist unflexed during the swing of a golf club through contact of the head of the golf club with a golf ball.

2. The device of claim 1 wherein the tactile sensation means does not substantially confine the wrist of the user.

3. The device of claim 1 wherein the tactile sensation means is an elongated member installed on the golf glove.

4. The device of claim 1 wherein the tactile sensation means is an elongated member installed in a pocket in the interior of the glove, said pocket being the means for changing the tactile sensation.

5. The device of claim 1 wherein the tactile sensation means is a stiff member installed in a pocket in the interior of the glove and wherein the pocket adjustably confines the elongated member in the pocket, said pocket being the means for changing the tactile sensation.

6. The device of claim 1 wherein the golf glove includes a wrist margin and closure and wherein the golf glove has a pocket in the interior of the glove and wherein the pocket extends from adjacent to the wrist margin of the glove into the interior of the glove, said pocket being the means for changing the tactile sensation.

7. The device of claim 6 wherein the tactile sensation means is adjustably received in the pocket.

8. A golf training aid comprising a golf glove, the golf glove having a wrist margin that does not extend substantially beyond a wrist pivot axis of a user's hand and an opening through the wrist margin into the interior of the glove, the glove having an elongated pocket therein, the pocket extending from adjacent to the wrist margin into the interior of the glove and angled towards a user's first knuckle but not extending beyond said first knuckle, the training aid including a tactile reminder, the tactile reminder including an elongated member received in the pocket of the glove, the pocket of the glove adjustably confining the elongated member whereby the elongated member can be positioned adjacent to the wrist of a user to provide a tactile sensation reminding the user to hold the wrist of the user straight during at least a portion of a golf swing.

9. The device of claim 8 wherein the elongated member is a thin strip of stiff material.

10. The device of claim 8 wherein the pocket extends into the interior of the glove to a location on the glove adjacent to the position of a first knuckle of a user.

11. The device of claim 8 wherein the glove adjustably and resiliently confines the elongated member in the pocket.

12. The device of claim 8 wherein the elongated member is a thin rectangular strip of a rigid or semi-rigid material.

13. A golf training aid comprising a golf glove for the target hand of a user of the golf glove, the golf glove having a wrist margin that does not extend substantially beyond a wrist pivot axis of a user's hand and a closure, the golf glove having a pocket with a proximal end of the pocket located adjacent to the wrist margin of the golf glove and angled towards a user's first knuckle but not extending beyond said first knuckle, the pocket having a tactile reminder therein to create a sensation of touch in the target hand of the user of the golf glove, the tactile reminder being resiliently and adjustably confined in the pocket to be adjustable to place the tactile reminder adjacent to the wrist of the target hand of the user of the golf glove, the golf glove, the pocket and the tactile reminder leaving the wrist of the target hand of the user of the golf glove substantially unconfined, whereby the user of the golf glove receives a tactile sensation reminding the user of the golf glove to hold the wrist of the target hand straight during the portion of a golf swing through contact of the head of a golf club with a ball and the flexibility of the target hand of the user is unconfined during the follow through of the golf swing.

14. The device of claim 13 wherein the wrist of the target hand of a user of the golf glove is not substantially confined during the swing of the user during finesse or cut shots and the user receives a reminding sensation during the swing for distance or power shots.

15. The device of claim 13 wherein the pocket is in the interior of the golf glove and extends into the interior of the glove with a distal end adjacent to a first knuckle position of a user of the golf glove and wherein the tactile reminder is an elongated member extending into the pocket.

* * * * *